United States Patent [19]

Rosaen

[11] Patent Number: 4,654,897

[45] Date of Patent: Apr. 7, 1987

[54] TAIL-LESS NECK SCARF

[76] Inventor: Leslie J. Rosaen, 45451 Turtlehead Dr., Plymouth, Mich. 48170

[21] Appl. No.: 803,071

[22] Filed: Nov. 29, 1985

[51] Int. Cl.[4] ..... A42B 5/00

[52] U.S. Cl. ..... 2/207; 2/91

[58] Field of Search ..... 2/91, 207, 174, 50, 2/203, 127

[56] References Cited

U.S. PATENT DOCUMENTS

| | | | |
|---|---|---|---|
| 1,197,205 | 9/1916 | Hindin | 2/50 |
| 1,967,054 | 7/1934 | Grean | 2/91 |
| 2,112,774 | 3/1938 | Thorman | 2/267 |
| 2,486,953 | 2/1950 | Pinnere | 2/91 |
| 2,510,720 | 6/1950 | Siegel | 2/91 |
| 2,804,626 | 9/1957 | Rossiter | 2/91 |
| 3,088,119 | 5/1963 | Grant | 2/267 |
| 3,286,275 | 11/1966 | Calisch | 2/91 |
| 3,479,667 | 11/1969 | Mehl | 2/91 |
| 3,748,661 | 7/1973 | Smith | 2/91 |
| 3,962,728 | 6/1976 | Pavlinik | 2/174 |
| 4,495,660 | 1/1985 | Hayden | 2/91 |

FOREIGN PATENT DOCUMENTS

| | | | |
|---|---|---|---|
| 161125 | 4/1921 | United Kingdom | 2/91 |

*Primary Examiner*—Doris L. Troutman

*Attorney, Agent, or Firm*—Gifford, Groh, VanOphem, Sheridan, Sprinkle and Dolgorukov

[57] ABSTRACT

A scarf is constructed from a rectangular and elongated imperforate piece of cloth having a uniform thickness and a homogeneous constitution. The scarf has a length slightly greater than the circumference of the wearer's neck. The scarf includes a pair of fasteners, one each on the opposing faces of the piece of cloth. One of the fasteners is engageable at a plurality of locations along the other fastener, so as to closely fit the scarf to the wearer's neck, eliminating the scarf tails resulting from conventional scarves.

13 Claims, 4 Drawing Figures

TAIL-LESS NECK SCARF

BACKGROUND OF THE INVENTION

I. Field of the Invention

The present invention relates to an article of wearing apparel, and more particularly to scarves and the like.

II. Description of the Prior Art

Scarves or mufflers have long been used for both decorative and utilitarian purposes. Most often, a scarf comprises an elongated piece of woven cloth having a length substantially longer than the circumference of the wearer's neck, and a uniform width larger than the vertical extent of the neck. The scarf is knotted or wrapped about the neck, so as to cover the neck and protect it from inclement weather. Decorative scarves are usually constructed from substantially thinner material than are utilitarian scarves, but are similarly draped about the body.

While the prior scarves have functioned adequately for their intended purposes of protection and decoration, their use has entailed some drawbacks. The dangling ends of an elongated scarf can pose a danger to the health and safety of the wearer, if the scarf is worn while the wearer is near or operates any equipment or machinery, such as an automobile engine, a bicycle, or a motorcycle. Merely tucking the free ends of the scarf inside the other clothing worn by the wearer is not a satisfactory solution. The clothing worn may not have a sufficient neck opening to allow the free ends of the scarf to be tucked therein, and the bulk of the free ends may be so great as to prevent the closure of a button or zipper-front article of clothing, thus defeating the protective purpose of the scarf. Moreover, the width of the conventional scarf often results in uneven longitudinal stretching of the material of the scarf when wrapped and tied about the neck, since the neck possesses a diversely curved surface. Lastly, decorative scarves generally provide little protection for the neck from the rain or cold.

SUMMARY OF THE PRESENT INVENTION

The present invention overcomes these and other difficulties by providing a scarf which has an attractive and streamlined appearance, which adquately protects the neck from the elements, and which avoids the potential for injury encountered by wearing a long-tailed scarf. The present invention invloves a substantially tail-less scarf whose length is closely dimensionable to the circumference of the neck of the wearer. The scarf according to the present invention comprises an elongated, imperforate piece of woven material having a pair of ends and a parallel pair of edges, one each at each of the ends. The piece of material possesses a length slightly greater than the circumference of the wearer's neck, and a width generally about equal to the length of the wearer's neck. Means are provided on each of the faces of the material piece, adjacent the ends, for together closely fastening the scarf about the wearer's neck. Preferably, the fastening means comprises one fastener on each of the faces adjacent the opposing edges, such that one of the fasteners is engagable with the other fastener at a number of locations along the other fastener, so as to vary the length of the scarf to match the circumference of the wearer's neck. Preferably, the fastening means comprises a pair of hook and loop type fasteners, such as a Velcro fastener. (VELCRO is a trademark for synthetic material which adheres when pressed together.) Also preferably, the ends of the scarf of the present invention are somewhat tapered, so that a pair of V-shaped notches are formed upon mating of the fasteners. The notches are positioned at the front of the neck. This advantageously promotes mobility of the neck while the scarf is being worn, and reduces the likelihood of separating the fasteners from the ends of the scarf upon their disengagement from one another.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF THE PREFERRED EMBODIMENT OF THE PRESENT INVENTION

Figure 3:
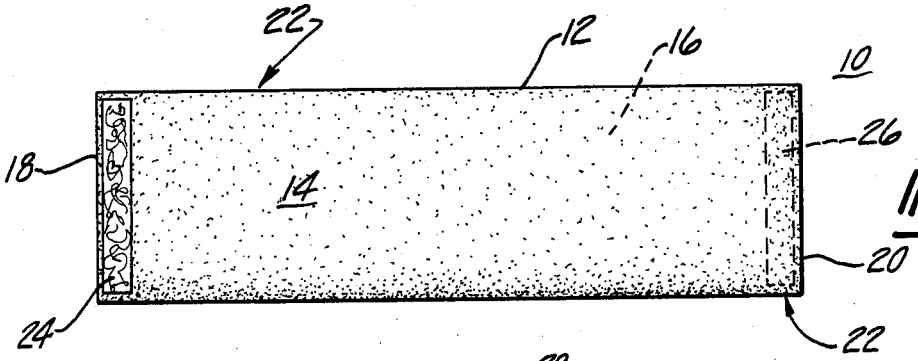
FIG. 3 is a plan view of a second preferred embodiment of the present invention.

With reference first to FIG. 3, a substantially tail-less scarf 10 according to the present invention first comprises a rectangular and elongated imperforate piece of cloth 12 having a substantially uniform thickness and a homogeneous constitution. "Homogeneous constitution" means that no stays, weights, or the like are disposed on or interiorly of the surface of the cloth. The piece of cloth 12 possesses a pair of opposing faces 14 and 16, and a pair of opposing edges 18 and 20 on its ends. A fastening means 22 is affixed to the faces 14 and 16 of the piece of cloth 12 for closely fastening the scarf 10 about the neck of a wearer. Preferably, the fastening means 22 comprises a pair of engageable fasteners 24 and 26 disposed one each on one of the faces 14 and 16 of the cloth 12 adjacent the edges 18 and 20. Advantageously, the fastening means 22 comprises a Velcro-type fastener, such that the fastener 24 comprises a looped strip disposed parallel to the one edge 18, adjacent to the one edge 18 on the one face 14. The fastener 26 comprises a hooked strip disposed parallel to the other edge 20, adjacent to the other edge 20, on the other face 16 of the piece of cloth 12. The looped strip 24 and the hooked strip 26 are of well known construction, and can be repeatedly engaged and disengaged easily, with a varying degree of overlap.

Figure 1:
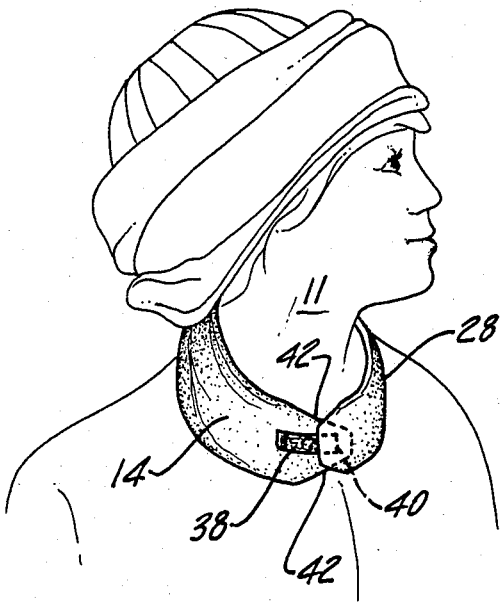
FIG. 1 is a front view of a first preferred embodiment of the present invention.
Figure 2:
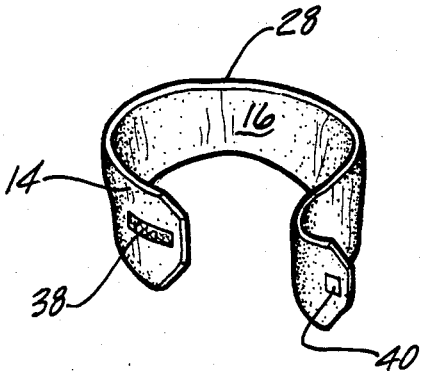
FIG. 2 is a perspective view of the preferred embodiment of the present invention.
Figure 4:
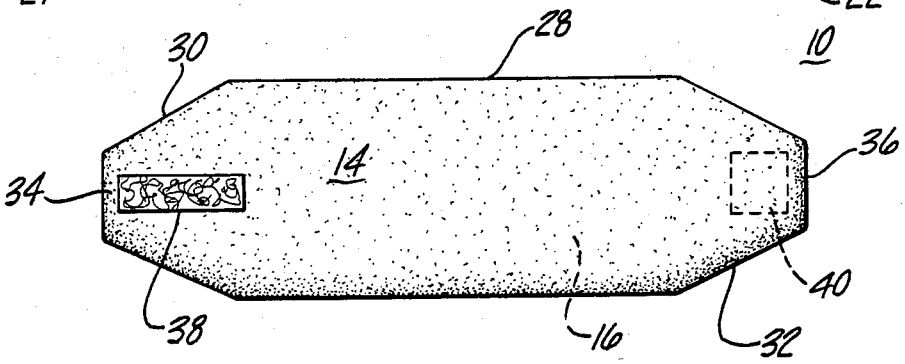
FIG. 4 is a plan view of the preferred embodiment of the present invention.

With reference now to FIGS. 1, 2 and 4, a particularly preferred embodiment of the scarf of the present invention is thereshown which comprises an elongated imperforate piece of cloth 28 having a substantially uniform thickness and a homeogeneous constitution, similar to the piece of cloth 12, but which has a pair of tapered ends 30 and 32. The piece of cloth 28 possesses a pair of opposing faces 14 and 16 like the piece of cloth 12. The piece of cloth 28 also possesses a pair of parallel edges 34 and 36 at opposite ends 30 and 32 of the piece of cloth 28. Since the ends 30 and 32 of the piece of cloth 28 are tapered, the parallel edges 34 and 36 do not extend the full width of the piece of cloth 28.

As with the piece of cloth 12, the fastening means 22 is attached to the faces 14 and 16 of the piece of cloth 28. However, in this second embodiment the fastening means first comprises a rectangular and elongated looped strip 38 on the one face 14 of the piece of cloth 28, extending perpendicularly from the one edge 34 of the piece of cloth 28. The fastening means 28 also comprises a relatively smaller, square hooked patch disposed on the other face 16 of the cloth 28, adjacent the other edge 36. The hooked patch 40 is engageable with the looped strip 38 anywhere along the looped strip 38, so as to vary the length of the scarf to match the circumference of the wearer's neck.

Use of the scarf according to the present invention is straightforward. With particular respect to the second-mentioned embodiment, the one end 30 of the piece of cloth 28 is disposed on the neck with the face 14 facing outwardly, such that the looped strip 38 also faces outwardly (FIGS. 1 and 2). The piece of cloth 28 is then brought around the neck such that the face 16 is brought into continuous contact with the surface of the wearer's neck 11. When the piece of cloth 28 is wrapped about the neck 11 in such a fashion, the hooked patch 40 is pressed onto the looped strip 38 at a location such that the length of the closed loop of cloth 28 matches the circumference of the wearer's neck 11. Tightening or loosening of the scarf is achieved by disengagement of the hooked patch 40 from the looped strip 38 and movement of the patch 40 to a different location on the looped strip 38 until a comfortable location is found. The scarf of the first-mentioned embodiment is used in a similar fashion.

In the second-mentioned embodiment of the present invention, a pair of V-shaped notches 42 are formed in the scarf at the front surface of the wearer's neck 11, upon engagement of the strip 38 and patch 40. This is advantageous for several reasons. First, while protecting the neck from the elements, the upper notch permits the free movement of the jaw, and rotation of the head upon the neck, while the scarf is being worn. Second, the lower notch obviates entanglement of the scarf with the other clothing worn by the wearer, thus easing rotation of the head and neck. Thirdly, both notches allow the end 32 of the scarf 10 to be grasped closely to the hooked patch 40, so that stress on the hooked patch 40 is at a minimum, even if the hands of the wearer are gloved. This reduction in stress makes it less likely that the hooked patch 40 will be torn from the face 16 of the elongated piece of cloth 28. Lastly, the double V-notch gives the scarf a distinctive appearance, which may advantageously effect the attitude of the wearer and lessen the wearer's discomfort from the weather.

The dimensions of the scarf 10 of the present invention are such that the scarf fits comfortably about the neck with substantially no tail. If the scarf 10 is constructed for a particular person, the overall length of the piece of cloth 12 or 28 should be about one and one half inches longer than the circumference of the wearer's neck. The width of the piece of cloth 12 or 28 should be about the length of the wearer's neck, or about four inches, for an adult having a neck with a 15 to 16 inch diameter. Preferably, however, the scarf 10 need not be sized to the particular wearer's neck. Rather, a plurality of scarves are most advantageously manufactured in a relatively small number of lengths, with the fasteners being of a large enough size to allow a given scarf 10 to be worn by wearers having neck sizes in a range of two to three inches. Thus, the typical range of neck sizes can be covered with only three or four scarf lengths, for example, 12, 14, 16 and 18 inches. Each of the strips 24 and 26, or the strip 38 and patch 40, are sufficiently wide in the longitudinal direction of the scarf to allow the fasteners to join at a plurality of locations therealong, and thereby permit the scarf 10 when fastened to match variations in the size the the neck of the wearer, on account of changes in weight or the like.

Having described my invention, however, many modifications thereto will become apparent to one skilled in the art to which it pertains, without deviation from the spirit of the present invention, as defined by the scope of the appended claims.

I claim:

1. A substantially tail-less scarf whose length is closely dimensionable to the circumference of a wearer's neck comprising:

an elongated, imperforate piece of material having a pair of faces, a pair of ends, and a parallel pair of straight edges disposed one each at one of said ends; said piece having a length somewhat greater than said circumference of said wearer's neck; and joinable means on said pair of faces for fastening said scarf about said wearer's neck, comprising a first fastener on one of said faces adjacent one of said edges, and a second fastener on the other of said faces adjacent the other of said edges;

wherein said first fastener is joinable at a plurality of locations along said second fastener so as to vary the circumference of the scarf to closely match the circumference of the wearer's neck; and wherein said ends of said piece of material are tapered sufficiently to form a pair of V-shaped notches along said material when said fasteners are joined together.

2. The invention according to claim 1, wherein said material is a woven material.

3. The invention according to claim 1, wherein said material is cloth.

4. The invention according to claim 1, wherein the length of said piece is slightly greater than the circumference of said wearer's neck.

5. The invention according to claim 1, wherein said fastening means comprises a pair of hook and loop type fastening members.

6. The invention according to claim 5, wherein each of said fasteners comprises an elongated strip disposed parallel to the associated edge of said piece of material.

7. The invention according to claim 1, wherein said fastening means comprises a pair of hook and loop type fasteners.

8. The invention according to claim 7, wherein said first fastener comprises an elongated loop type fastener strip disposed adjacent the center of said one edge and extending perpendicularly from said one edge; and wherein said second fastener comprises a square hook type fastener type patch disposed adjacent the center said other edge.

9. The invention according to claim 1, wherein said material possesses a substantially uniform cross section and homogeneous constitution.

10. A substantially tail-less scarf whose length is closely dimensionable to the circumference of a wearer's neck comprising:

an elongated, imperforate piece of material having a pair of faces, a pair of ends, and a parallel pair of straight edges disposed one each at one of said ends; said piece having a length somewhat greater than said circumference of said wearer's neck; and joinable means on said pair of faces for fastening said scarf about said wearer's neck, comprising a first fastener on one of said faces adjacent one of said edges, and a second fastener on the other of said faces adjacent the other of said edges;

wherein said first fastener is joinable at a plurality of locations along said second fastener so as to vary the circumference of the scarf to closely match the circumference of the wearer's neck; and wherein said material possesses a substantially uniform cross section and homogeneous constitution.

11. The invention according to claim 4, wherein said ends of said piece of material are tapered.

12. A substantially tail-less scarf whose length is closely dimensionable to the circumference of a wearer's neck, consisting essentially of;

an elongated, imperforate piece of woven cloth having a substantially uniform thickness, cross section, and homogeneous constitution, and having a pair of faces, a pair of tapered ends, and a parallel pair of straight edges disposed one each at one of said ends; said piece having a length somewhat greater than said circumference of said wearer's neck;

an elongated loop type fastener strip disposed on one of said faces adjacent the center of one of said edges and extending perpendicularly from said one edge; and a square hook type fastener patch disposed on the other of said faces adjacent the center of the other of said edges, such that said square patch is fastenable to said elongated strip at a plurality of locations along said elongated strip, so as to closely match the circumference of said scarf to said circumference of said wearer's neck.

13. The invention according to claim 11, wherein the ends of said piece of material are tapered.

* * * * *